US006789673B2

(12) United States Patent
Lingamfelter

(10) Patent No.: US 6,789,673 B2
(45) **Date of Patent: *Sep. 14, 2004**

(54) CONTAINER FOR PROVIDING EASY ACCESS TO BEVERAGE CANS

(76) Inventor: C. Brown Lingamfelter, 920 Depot Rd., Foxborough, MA (US) 01710

( * ) Notice: Subject to any disclaimer, the term of this patent is extended or adjusted under 35 U.S.C. 154(b) by 0 days.

This patent is subject to a terminal disclaimer.

(21) Appl. No.: 10/388,951

(22) Filed: Mar. 14, 2003

(65) Prior Publication Data

US 2004/0089575 A1 May 13, 2004

Related U.S. Application Data

(63) Continuation of application No. 09/946,004, filed on Sep. 4, 2001, now Pat. No. 6,550,615, and a continuation of application No. 09/542,661, filed on Apr. 4, 2000, now Pat. No. 6,283,293.

(51) Int. Cl.[7] ..... B65D 75/00
(52) U.S. Cl. ..... 206/427; 229/164
(58) Field of Search ..... 206/427, 499, 206/161, 193, 446; 229/164, 117.13, 117.15, 122.1, 122, 108, 229, 237, 238, 240, 242; 221/31, 32, 303, 305

(56) References Cited

U.S. PATENT DOCUMENTS

| | | | | |
|---|---|---|---|---|
| 1,541,143 A | | 6/1925 | Hoile | |
| 1,925,102 A | | 9/1933 | Levkoff | |
| 2,448,819 A | * | 9/1948 | Mitchell | 229/242 |
| 2,718,301 A | | 9/1955 | Palmer | |
| 2,723,027 A | | 11/1955 | Guyer | |
| 2,842,304 A | | 7/1958 | Ringler | |
| 2,930,516 A | | 3/1960 | Fowle et al. | |
| 2,975,891 A | | 3/1961 | Stone | |
| 3,178,242 A | | 4/1965 | Ellis et al. | |

(List continued on next page.)

FOREIGN PATENT DOCUMENTS

| | | |
|---|---|---|
| DE | 7510538 | 8/1975 |
| DE | 8514718.4 | 8/1985 |
| DE | 3612594 A1 | 10/1987 |
| EP | 0849189 A1 | 6/1998 |
| WO | WO 96/29260 | 9/1996 |
| WO | WO 97/21607 | 6/1997 |

*Primary Examiner*—Luan K. Bui
(74) *Attorney, Agent, or Firm*—Jackson Walker LLP

(57) ABSTRACT

A container having a multiplicity of cans therein. The container disclosed is modified from a rectangular, closed wall container to a container with part of the walls removed, thereby allowing easy access to the cans of the container. Applicant discloses a unique relationship between the walls of the opened container and the size of the beverage cans. Applicant also discloses a method for constructing a closed container that may be easily modified to remove the cans of the container.

29 Claims, 3 Drawing Sheets

U.S. PATENT DOCUMENTS

| | | | |
|---|---|---|---|
| 3,228,582 | A | 1/1966 | Osberg |
| 3,263,861 | A | 8/1966 | Carr |
| 3,265,283 | A | 8/1966 | Farquhar |
| RE26,083 | E | 9/1966 | Forrer |
| 3,300,115 | A | 1/1967 | Schauer |
| 3,356,279 | A | 12/1967 | Root |
| 3,517,858 | A | 6/1970 | Farquhar |
| 3,540,581 | A | 11/1970 | Koolnis |
| 3,669,251 | A | 6/1972 | Phillips, Jr. |
| 3,765,327 | A | 10/1973 | Aronson et al. |
| 3,765,527 | A | 10/1973 | Vargo |
| 3,894,681 | A | 7/1975 | Arneson et al. |
| 3,913,739 | A | 10/1975 | Hennessey |
| 4,000,811 | A | 1/1977 | Hardison et al. |
| 4,030,596 | A | 6/1977 | Snyder et al. |
| 4,214,660 | A | 7/1980 | Hunt, Jr. |
| 4,222,485 | A | 9/1980 | Focke |
| 4,364,509 | A | 12/1982 | Holley et al. |
| 4,375,258 | A | 3/1983 | Crayne et al. |
| 4,396,143 | A | 8/1983 | Killy |
| 4,416,410 | A | 11/1983 | Herrmann |
| 4,417,661 | A | 11/1983 | Roccaforte |
| 4,582,199 | A | 4/1986 | Schuster |
| 4,726,471 | A | 2/1988 | Whately et al. |
| 4,919,266 | A | 4/1990 | McIntosh, Jr. et al. |
| 4,974,771 | A | 12/1990 | Lavery |
| 5,123,589 | A | 6/1992 | Cote |
| 5,137,211 | A | 8/1992 | Summer et al. |
| 5,170,934 | A | 12/1992 | Lemoine |
| 5,279,440 | A | 1/1994 | Fougeres et al. |
| 5,368,194 | A | 11/1994 | Oliff et al. |
| 5,465,831 | A | 11/1995 | Smith |
| 5,622,309 | A | 4/1997 | Matsuda et al. |
| 5,722,584 | A | 3/1998 | Fujiwara |
| 5,775,574 | A | 7/1998 | Whitnell |
| 5,878,947 | A | 3/1999 | Hoy et al. |
| 6,105,854 | A | 8/2000 | Spivey et al. |
| 6,176,419 | B1 | 1/2001 | Holley, Jr. |
| 6,283,293 | B1 | 9/2001 | Lingamfelter |

* cited by examiner

CONTAINER FOR PROVIDING EASY ACCESS TO BEVERAGE CANS

This application is a continuation and claims priority from U.S. patent application Ser. No. 09/946,004 filed Sep. 4, 2001, now U.S. Pat. No. 6,550,615 and U.S. patent application Ser. No. 09/542,661 filed Apr. 4, 2000, now U.S. Pat. No. 6,283,293.

BACKGROUND OF THE INVENTION

1. Field of the Invention

Beverage can containers, more specifically a beverage can container for providing easy access to the beverage cans contained therein.

2. Background Information

Beverages, such as soda or beer, often come in cylindrical, aluminum, typically 12 oz. cans. Traditionally, one could buy a single can or a "six pack." The six pack is simply six cans contained in a typically rectangular paper container or hung on interconnected plastic rings.

More recently, cans of soda and beer have become available in packs of twelve cans. The twelve pack is typically rectangular cardboard with the cans, usually in a 4×3 matrix arrangement, stacked closely next to one another. The twelve pack has walls typically constructed of light cardboard or thick paperboard, being thicker than writing stock paper but not as robust or thick as corrugated cardboard. These twelve packs presently enjoy popularity with use by Coca-Cola and Pepsi-Cola, the two leading providers of soda as well as by many major domestic beer companies.

The twelve pack containers provide a convenient means to carry the beverage cans but are not handy for dispensing the cans. Typically, the consumer will purchase the twelve pack, bring it home, tear the pack open and pull out the cans to stack them in the refrigerator, discarding the container. Applicant provides, however, for a modification to the currently available twelve pack to convert the carrying container to a dispensing container. That is, the cans will remain within the carrying container, the container acting, as modified by applicant as a beverage can dispenser.

An object of Applicant's present invention is to provide for a container for beverage cans which will allow easy access to the beverage cans for easy removal but will also hold the beverage cans therein.

It is also an object of Applicant's present invention to provide a modification to currently existing beverage can containers so that the containers, as modified, will provide easy access to the cans therein.

This and other objects are provided for in a generally rectangular, paper beverage can container with a corner removed on a diagonal line across the two side walls, the line running from a front wall to the adjacent top wall.

There are a number of benefits with Applicant's novel beverage container with a dispensing cutout therein. These include ease of access. This is obtained by placing the twelve pack container on edge with a cutout in the upper corner. Easy and fast accessibility to the cold beverage cans will increase consumption and sales of the product.

Applicant's invention also provides for gravity feed to enhance access to the beverage cans. This is created by the weight of the cans when the beverage container is placed in a vertical position. This position naturally pushes the cans, under the influence of gravity, towards the front wall of the container. The cutout location is designed to take maximum advantage of this gravity feed.

Another advantage of Applicant's invention is the ability to effectively utilize space, especially in a refrigerator or kitchen cabinet. By placement of the cutout in the position indicated, the container may be placed vertically to save space.

DETAILED DESCRIPTION OF THE PREFERRED EMBODIMENT

Line 12A shows the position of a line on the front wall of a beverage container from one side wall to the next, the line being straight and meeting the edge between the front wall and the side wall at a 90° angle. The line 12D shows the position of a diagonal line across each of the two side walls between the front wall and the top wall, lines 12D, at 12B and 12C showing a preferred range of the position of line 12D with respect to the top wall. Line 12E is a line across the top wall, one side wall to the next and perpendicular to the edges of the top wall. The beverage container will be cut through along lines 12A, 12D and 12E to remove section 12 from the rest of the container (See FIG. 1B). The position of lines 12A, 12D and 12E may be premarked, scored (or otherwise weaken) by the manufacturer of the beverage container so as to direct the consumer to the position for cutting and removing portion 12.

Figure 1:
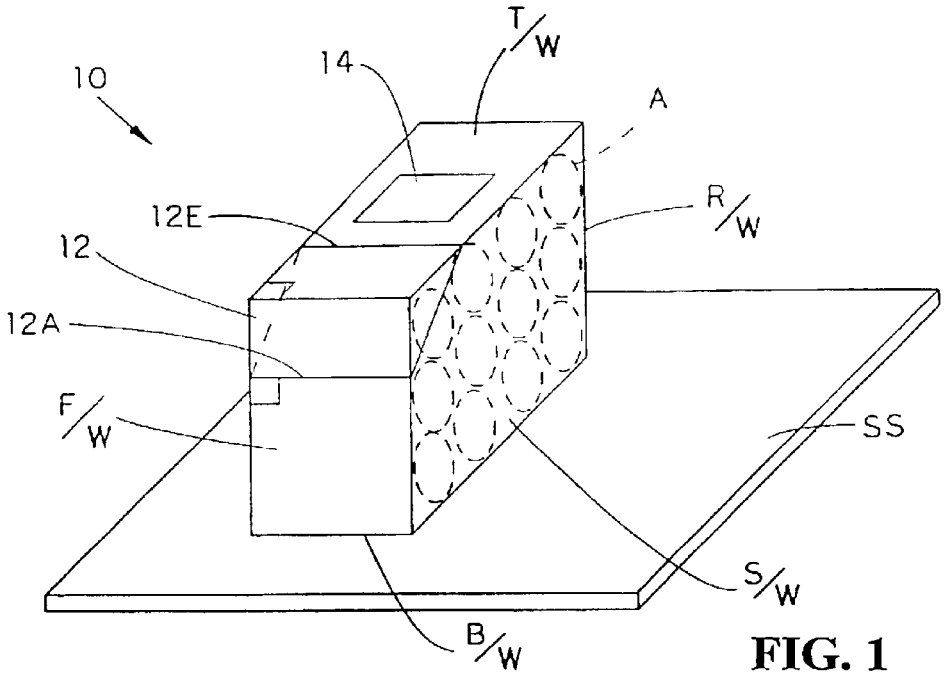
FIG. 1 is a perspective view of the preferred embodiment of applicants invention.
Figure 1B:
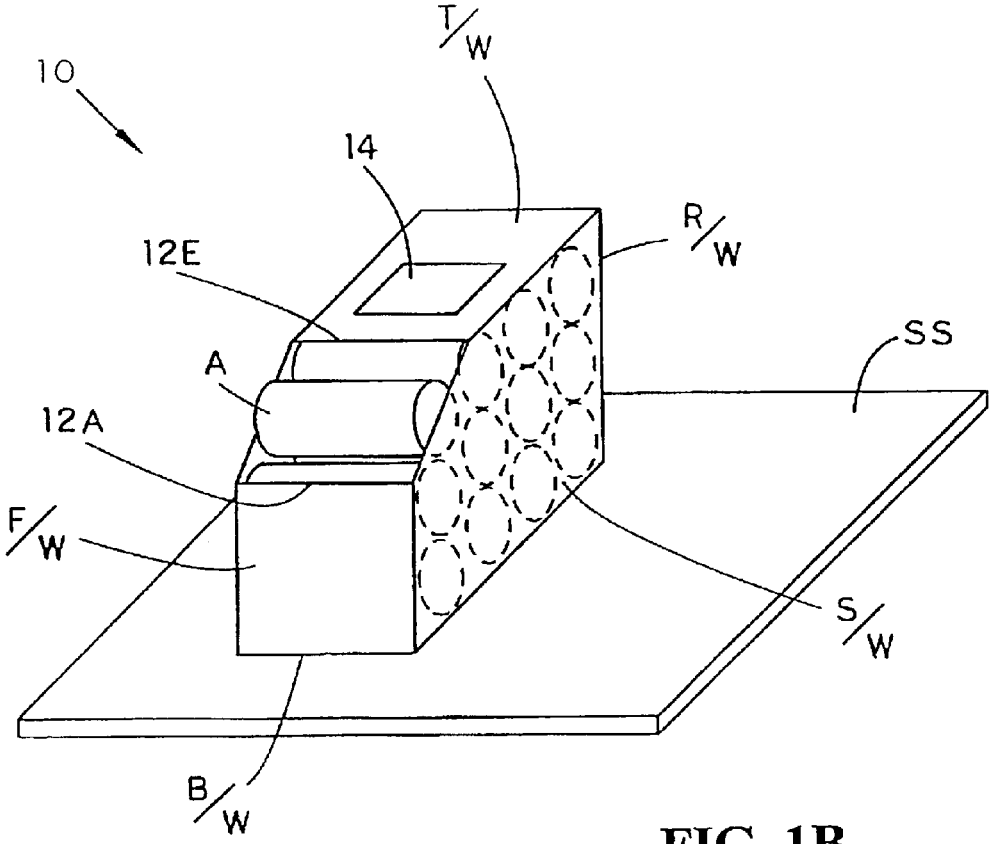
FIG. 1B is a perspective view of the beverage container modified accordingly to Applicants invention.

FIG. 1 is a perspective view of a modified twelve pack container 10 with cylindrical aluminum 12 oz. beverage cans A packed inside in a 4×3 arrangement and designating two side walls S/W, a top wall T/W, a bottom wall B/W, a front wall F/W and a rear wall R/W. It is noted that the two side walls have the greatest surface area, the top and bottom walls having a surface area between the two side walls and the front and rear walls, which have the least surface area. A support surface, such as a refrigerator shelf, is designated SS. The top, bottom, front and rear walls are defined when the container is placed on a support surface, as illustrated in FIG. 1, with the F/W chosen to provide for the most convenient access. FIG. 1 also illustrates Applicant's modification, being a cut or removed portion 12, the removed portion being a corner of the container where the front wall meets the top wall and defined by a diagonal line across the two sidewalls between the front wall and the top wall, and a line across the top wall and across the front wall, this line along which the removed portion is defined designated 12A.

Figure 2:
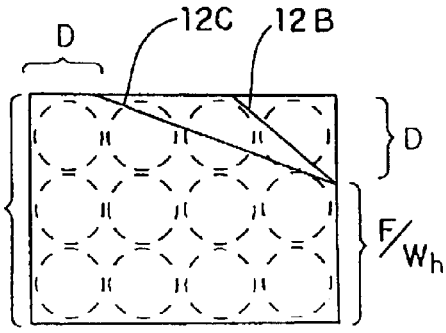
FIG. 2 is a side elevational view of the preferred embodiment of applicants invention.
Figure 1A:
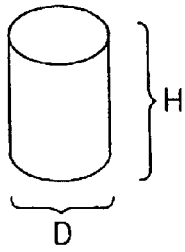
FIG. 1A is side view of a 12 oz. beverage can.

FIG. 2 illustrates a side elevational view of the twelve pack of FIG. 1 wherein the dimension designated D is the approximate diameter of a 12 oz. aluminum beverage can, typically about 6.6 centimeters. As can be seen in FIGS. 1 and 2 the typical twelve pack beverage container is a little over 4 diameters long (about 26 cms) and about 3 "diameters" high (about 20 cms) to enclose therein, in a 3×4 matrix, twelve cans. Furthermore it sometimes includes a handle 14 thereon, the handle typically being walls defining a cut out in the top wall for the receipt of a hand thereinto. The height (H) of a typical 12 oz. metal beverage can is about 12.6 cm.

In FIG. 2 it is seen that Applicant modifies the standard heavy paper wall twelve pack container by cutting off the corner created by the joinder of the front wall and top wall. This is preferably done in the manner illustrated in FIGS. 1 and 2. The preferred height of the front wall defined after the cut across the front wall is less than two diameters but greater than one diameter, more preferably between 1.50 and 1.80 times D. Indeed, the most preferred height of the front wall defining the cut to remove portion 12 is between 1¼ diameter and 1¾ diameter. Such dimension allows easy receipt of the second course of cans but is high enough to prevent the second course of cans from falling out when there are still 3 courses in the container.

The preferred length of the top wall defined after the cut is between 1 and 3 diameters, preferably between 1 and 2 diameters. These cut dimensions are illustrated by lines 12B and 12C set forth in FIG. 2.

Cuts along the lines 12A, 12D and 12E may be made with a knife, razor or any other suitable instrument. When the cuts are made as set forth in FIGS. 1 and 2, portion 12 can be removed (See FIG. 1B) and the single can at the top corner will then be removed and the container placed in the position illustrated in FIG. 1 for easy dispensing of the remaining cans.

Figure 3:
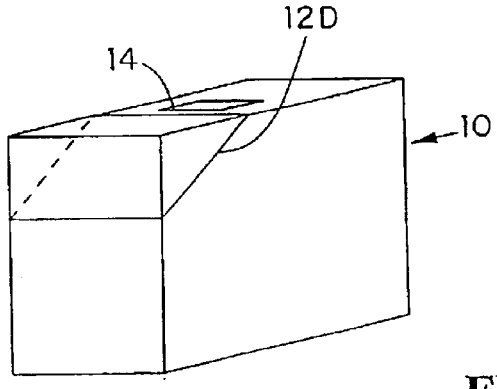
FIG. 3 is a side elevational view of an embodiment of Applicants invention.

FIG. 3 provides for a diagonal cut 12C across the side walls S/W's that terminates adjacent handle 14. Handle 14, in a 4×3 twelve pack is usually at 2 diameters from a top edge (half way across top wall T/W) to provide for proper balance.

Figure 4:
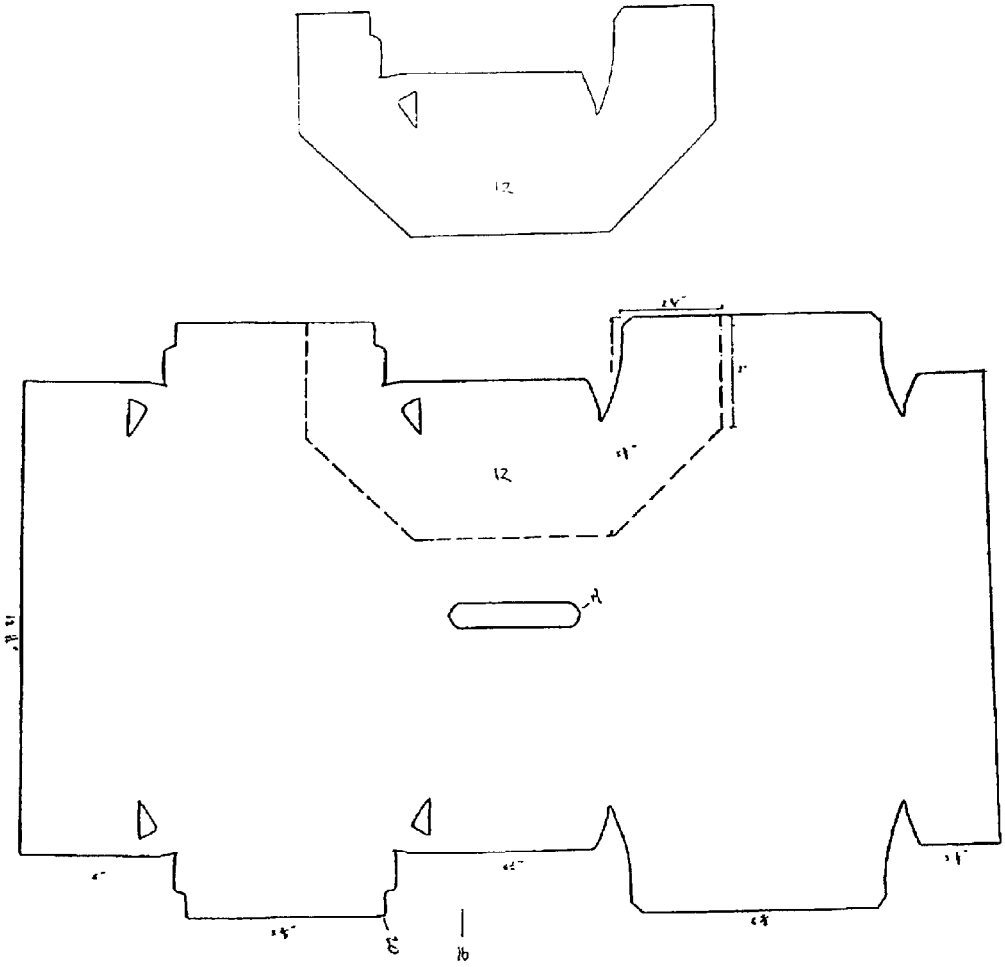
FIG. 4 is a two dimensional pattern of a typical paper twelve pack container illustrating the area removed to provide for applicants unique dispenser.

FIG. 4 illustrates a flattened twelve pack pattern 16 which will fold together to provide for a typical twelve pack with dimension. Handle 14 is illustrated. Scored line 18 is made as part of the process of constructing the container, typically after the outer perimeter 20 defining the pattern 16 of the box is formed. Scored line 18 may be grooves, scratches or notches, or any other means known in the trade to weaken the paperboard such that it is easier for the user to remove portion twelve. Indeed, with proper scoring in ways known in the trade, it is fairly easy to remove portion twelve without a cutting instrument. Note in FIG. 4 that folding the pattern 16 will provide for the twelve pack illustrated in FIGS. 1–3 with the diagonal line 12D running across the side walls from the front wall F/W to the top wall T/W.

In an alternate preferred embodiment Applicant provides a twelve pack container with a line marked on the front wall F/W at between 1D and 2D, on the top wall T/W between 1D and 3D and across the two side walls S/W's to define the pattern for removal of a corner 12 of a twelve pack container as illustrated in FIGS. 1–4 to show a consumer that they may cut the container along the line to convert it into the Applicants novel dispenser container as illustrated.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

I claim:

1. A container for holding a multiplicity of cylindrical cans, each can having a can diameter and a can height, the container comprising:

twelve cylindrical cans, each can comprising a can diameter and a can height, each can further comprising a longitudinal axis;

a rear wall having a rear wall height of about a whole multiple of the can diameter;

a front wall having a front wall height, the front wall height being less than the rear wall height by at least about 1.2 times the can diameter, the front wall being substantially parallel to the longitudinal axes;

a bottom wall having a bottom wall length of about a whole multiple of the can diameter;

a top wall having a top wall length less than the bottom wall length by at least about the can diameter; and two side walls, each of the side walls having a front edge running from the front wall to the top wall, wherein at least part of each edge is oblique with respect to the front wall and the top wall, the sidewalls separated by about the can height.

2. The container of claim 1, wherein the front wall height is less than the rear wall height by an amount in the range of about 1.2 to about 1.5 times the can diameter.

3. The container of claim 1, and further comprising a handle defined at least partially by a cut-out in the top wall.

4. The container of claim 1, wherein all the walls comprise paper.

5. The container of claim 1, wherein the rear wall height and the bottom wall length are different.

6. A container holding a multiplicity of substantially identical items arranged in a plurality of rows and columns, each item having an item diameter and an item height, wherein the arrangement has a top row and a next-to-the-top row, and wherein each column has a column width of about the item diameter and each row has a row height of about the item diameter, comprising:

a rear wall having a rear wall height of about a whole multiple of the row height;

a bottom wall for resting on a support surface having a bottom wall length of about a whole multiple of the column width;

a front wall having a front wall height less than the rear wall height but sufficiently high to restrain the next-to-the-top row of items when the bottom wall is resting on the support surface;

a top wall having a top wall length less than the bottom wall length by at least about the column width;

two side walls, each of the side walls having a front edge running from the front wall to the top wall, wherein at least part of each edge is oblique with respect to the front wall and the top wall, the sidewalls separated by about the item height; and wherein the multiplicity of substantially identical items comprises twelve items, and wherein each of the items comprises a longitudinal axis substantially parallel to the front wall.

7. The container of claim 6, wherein the front wall height is less than the rear wall height by an amount in the range of about 1.2 to about 1.5 times the row height.

8. The container of claim 6, and further comprising a handle defined at least partially by a cut-out in the top wall.

9. The container of claim 6, wherein all the walls comprise paper.

10. The container of claim 6, wherein the rear wall height and the bottom wall length are different.

11. A container holding a multiplicity of cylindrical cans, each can having a can diameter and a can height, the container comprising:

a rear wall and a front wall each having a height of about a whole multiple of the can diameter;

a bottom wall and a top wall each having a length of about a whole multiple of the can diameter;

two side walls between the bottom and top walls, the sidewalls separated by about the can height;

a scored line having a front wall segment running on the front wall, a top wall segment running on the top wall, and side wall segments running on the side walls, the scored line defining a removable section of the container, and wherein at least a part of the front wall segment runs at a height less than the rear wall height by an amount in the range of about 1.2 to about 1.5 times the can diameter, at least part of the top wall segment runs along about a can diameter from the front wall, and at least a part of each of the side wall segments runs obliquely with respect to the front wall and the top wall; and wherein each of the cans comprises a longitudinal axis, and wherein the front wall is substantially parallel to the longitudinal axis.

12. The container of claim 11, and further comprising a handle defined at least partially by a cut-out in the top wall.

13. The container of claim 11, wherein all the walls comprise paper.

14. The container of claim 11, wherein the rear wall height and the bottom wall length are different.

15. A method of providing easy access to items arranged in a container in a plurality of rows and columns, each item having an item diameter and an item height, wherein the arrangement has a top row and a next-to-the-top row, and wherein each column has a column width of about the item diameter and each row has a row height of about the item diameter, comprising:

providing a rectangular paper container comprising six rectangular walls including two side walls separated by about the item height, a front wall and a rear wall having a height of about a whole multiple of the row height, and a top wall and a bottom wall adapted to rest on a support surface, the bottom wall having a length of about a whole multiple of the column width;

scoring a front wall score on the front wall, at least a part of the front wall score being made at a height less than the rear wall height but sufficiently high to restrain the next-to-the-top row of items when the bottom wall is resting on the support surface and when the front wall is separated at the front wall score;

scoring a top wall score on the top wall, at least part of the top wall score being made about an item diameter from the front wall;

scoring side wall scores on the side walls, at least a part of each of the side wall scores being made oblique to the front wall and the top wall; and wherein the scores define a section, the removal of which allows easy access to the items, and wherein each of the items comprises a longitudinal axis substantially parallel to items, and wherein each of the items comprises a longitudinal axis substantially parallel to the front wall.

16. The method of claim 15, wherein the height that is sufficiently high to restrain the next-to-the-top row of items is in the range of about 1.2 to about 1.5 times the row height below the rear wall height.

17. The method of claim 15, and further comprising cutting out a section of the top wall to define a handle.

18. The method of claim 15, wherein the rear wall height and the bottom wall length are different.

19. A container comprising:

twelve substantially identical cylindrical twelve-ounce beverage cans, each can having a height and a diameter;

a rectangular paper carton, adapted to contain the twelve cylindrical beverage cans in a row and column arrangement, the row and column arrangement including a top row and a next-to-the-top row, each of the rows having a respective bottom level, the rectangular paper carton including a front wall, a rear wall, a top wall, a bottom wall for resting on a support surface, and two side walls, the front and rear walls having a height, the top and bottom walls having a length, the rectangular paper carton further adapted to enclose the twelve cylindrical beverage vans such that the height of the front wall and the height of the rear wall is about equal to a multiplicity of whole can diameters and the length of the bottom wall and the length of the top wall is about equal to about a multiplicity of whole can diameters and wherein the front wall includes a front wall scored line segment located below the bottom level of the top row and above the bottom level of the next-to-the-top row such that removal of a front wall portion above the front wall scored line segment will define a lip that will retain the next-to-the-top row of cylindrical cans from falling out of the container when the bottom wall is on a support surface, and wherein the top wall includes a top wall scored line segment such that removal of a top wall portion in front of the top wall scored line segment results in, in conjunction with the removal of the front wall portion above the front wall scored line segment, an opening providing access to the beverage cans.

20. The container of claim 19, wherein the front wall scored line segment is located at a height less than the rear wall height by an amount in the range of shout 1.2 to about 1.5 times the can diameter.

21. The container of claim 19, wherein each of the beverage cans comprises a longitudinal axis, and wherein the front wall is substantially parallel to the longitudinal axes.

22. The container of claim 19, and further comprising a handle defined at least partially by a cut-out in the top wall.

23. The container of claim 19, wherein all the walls comprise paper.

24. The container of claim 19, wherein the rear wall height and the bottom wall length are different.

25. A method of manufacturing a container:

providing a paper sheet member;

scoring a portion of the sheet member with a score line;

folding the sheet member around a plurality of cans, each of the cans having a can height, a can diameter, and a longitudinal axis, the folded sheet member defining a generally rectangular container having a top wall, a bottom wall, a front wall, a rear wall, and two side walls containing the cans arranged in a plurality of stacked rows, the plurality of stacked rows containing at least a top row and a next-to-the-top row, wherein a row height is about equal to the can diameter and wherein the front wall and the rear wall have a height of about a whole multiplicity of row heights and the top wall and the bottom wall have a length of about a whole multiplicity of can diameters, and the sidewalls are separated about a can height, and wherein folding the sheet member further comprises:

locating at least a portion of the score line between a bottom of the top row and a bottom of the next-to-the-top row;

orienting the front wall substantially parallel to the longitudinal axes; and locating at least a portion of the score line on the top wall and the side walls.

26. The method of claim 25, wherein locating at least a portion of the score line between a bottom of the top row and a bottom of the next-to-the-top row comprises locating at least a portion of the score line at a height less than the rear wall height by an amount in the range of about 1.2 to about 1.5 times the can diameter.

27. The method of claim 25, wherein the plurality of cans comprises twelve cans.

28. A container comprising:

a plurality of cans, each can comprising a can diameter and a can height, each can further comprising a longitudinal axis;

a rear wall having a rear wall height of about a whole multiple of the can diameter;

a front wall having a front wall height, the front wall height being less than the rear wall height by about 1.2 to 1.5 times the can diameter, the front wall being substantially parallel to the longitudinal axes;

a bottom wall having a bottom wall length of about a whole multiple of the can diameter;

a top wall having a top wall length less than the bottom wall length; and two side walls, each of the side walls having a front edge running from the front wall to the top wall, wherein at least part of each edge is oblique with respect to the front wall and the top wall, the sidewalls separated by about the can height.

29. The method of claim 28, wherein the plurality of cans comprises twelve cans.

* * * * *

US006789673C1

(12) INTER PARTES REEXAMINATION CERTIFICATE (538th)

United States Patent
Lingamfelter

(10) Number: US 6,789,673 C1
(45) **Certificate Issued: *Feb. 22, 2013**

(54) CONTAINER FOR PROVIDING EASY ACCESS TO BEVERAGE CANS

(76) Inventor: C. Brown Lingamfelter, Foxborough, MA (US)

Reexamination Request:
No. 95/000,069, Dec. 3, 2004
No. 95/000,066, Dec. 17, 2004

Reexamination Certificate for:

| | |
|---|---|
| Patent No.: | **6,789,673** |
| Issued: | **Sep. 14, 2004** |
| Appl. No.: | **10/388,951** |
| Filed: | **Mar. 14, 2003** |

( * ) Notice: This patent is subject to a terminal disclaimer.

Related U.S. Application Data

(63) Continuation of application No. 09/946,004, filed on Sep. 4, 2001, now Pat. No. 6,550,615, and a continuation of application No. 09/542,661, filed on Apr. 4, 2000, now Pat. No. 6,283,293.

(51) Int. Cl.
*B65D 75/00* (2006.01)

(52) U.S. Cl. ..... 206/427; 229/164

(58) Field of Classification Search ..... 206/161, 206/193, 427, 446, 499; 229/108, 117.13, 229/117.15, 122, 122.1, 229, 237, 238, 240, 229/242; 221/31, 32, 303, 305
See application file for complete search history.

(56) References Cited

To view the complete listing of prior art documents cited during the proceedings for Reexamination Control Numbers 95/000,069 and 95/000,066, please refer to the USPTO's public Patent Application Information Retrieval (PAIR) system under the Display References tab.

*Primary Examiner* — Jimmy G. Foster

(57) ABSTRACT

A container having a multiplicity of cans therein. The container disclosed is modified from a rectangular, closed wall container to a container with part of the walls removed, thereby allowing easy access to the cans of the container. Applicant discloses a unique relationship between the walls of the opened container and the size of the beverage cans. Applicant also discloses a method for constructing a closed container that may be easily modified to remove the cans of the container.

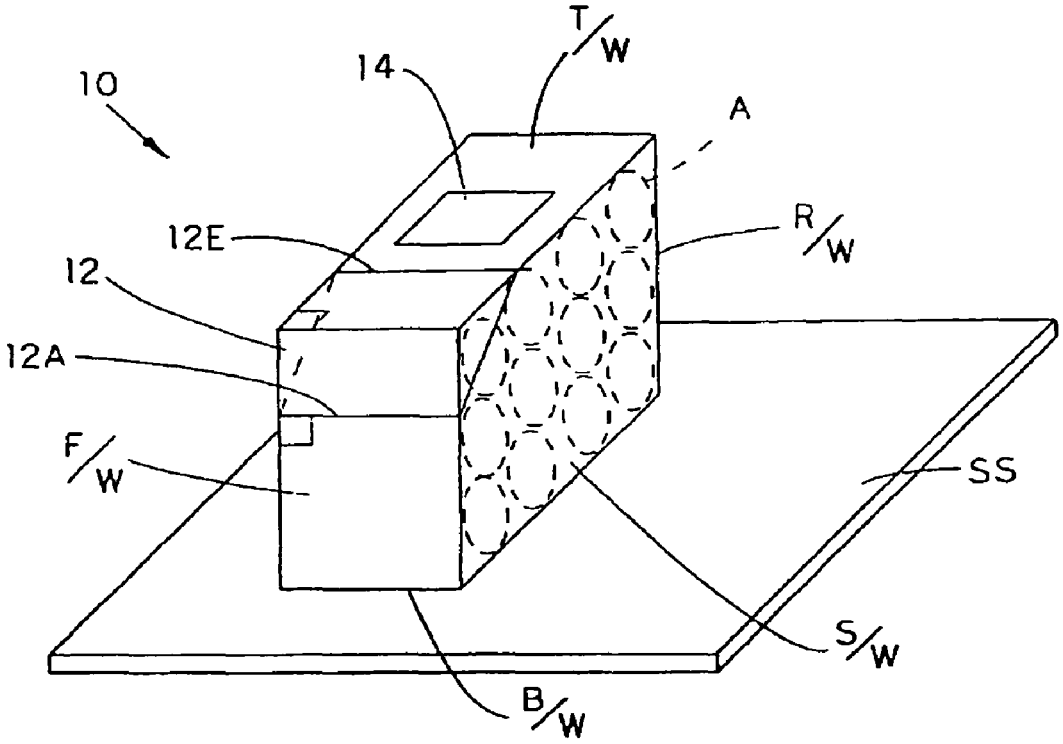

INTER PARTES REEXAMINATION CERTIFICATE ISSUED UNDER 35 U.S.C. 316

THE PATENT IS HEREBY AMENDED AS INDICATED BELOW.

AS A RESULT OF REEXAMINATION, IT HAS BEEN DETERMINED THAT:

Claims 1-29 are cancelled.

* * * * *